United States Patent [19]

Develay

[11] Patent Number: 4,490,189

[45] Date of Patent: Dec. 25, 1984

[54] METHOD OF MANUFACTURING STAMPED-OUT OR FORGED PARTS MADE OF ALUMINUM ALLOYS

[75] Inventor: Roger Develay, Voreppe, France

[73] Assignee: Aluminium Pechiney, Paris, France

[21] Appl. No.: 471,668

[22] Filed: Mar. 3, 1983

[30] Foreign Application Priority Data

Apr. 13, 1982 [FR] France ..... 82 06705

[51] Int. Cl.[3] ..... C21D 8/00

[52] U.S. Cl. ..... 148/12.7 A; 148/2; 148/11.5 A; 148/159

[58] Field of Search ..... 148/11.5 A, 2, 12.7 A, 148/159, 437, 438

[56] References Cited

U.S. PATENT DOCUMENTS 3,234,054 2/1966 Sperry ..... 148/11.5 A
3,418,177 12/1968 Pryor ..... 148/11.5 A
3,642,542 2/1972 Sperry et al. ..... 148/12.7 A
4,019,931 4/1977 Setzer et al. ..... 148/12.7 A

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

A method of manufacturing stamped-out or forged parts made of high-resistance aluminum alloy, in particular those corresponding to the 2000, 6000 or 7000 series of the Aluminium Association.

The method, which is applicable to automated, mass-production manufacture, entails quenching the products from the hot deformation heat ($T'_2$) which occurs after reheating the blooms at the homogenization temperature ($T_1$) or the solution heat treatment temperature ($T_3$).

The products obtained have uses which are analogous to those of products obtained in a classic manner.

5 Claims, 4 Drawing Figures

METHOD OF MANUFACTURING STAMPED-OUT OR FORGED PARTS MADE OF ALUMINUM ALLOYS

Figure 1:
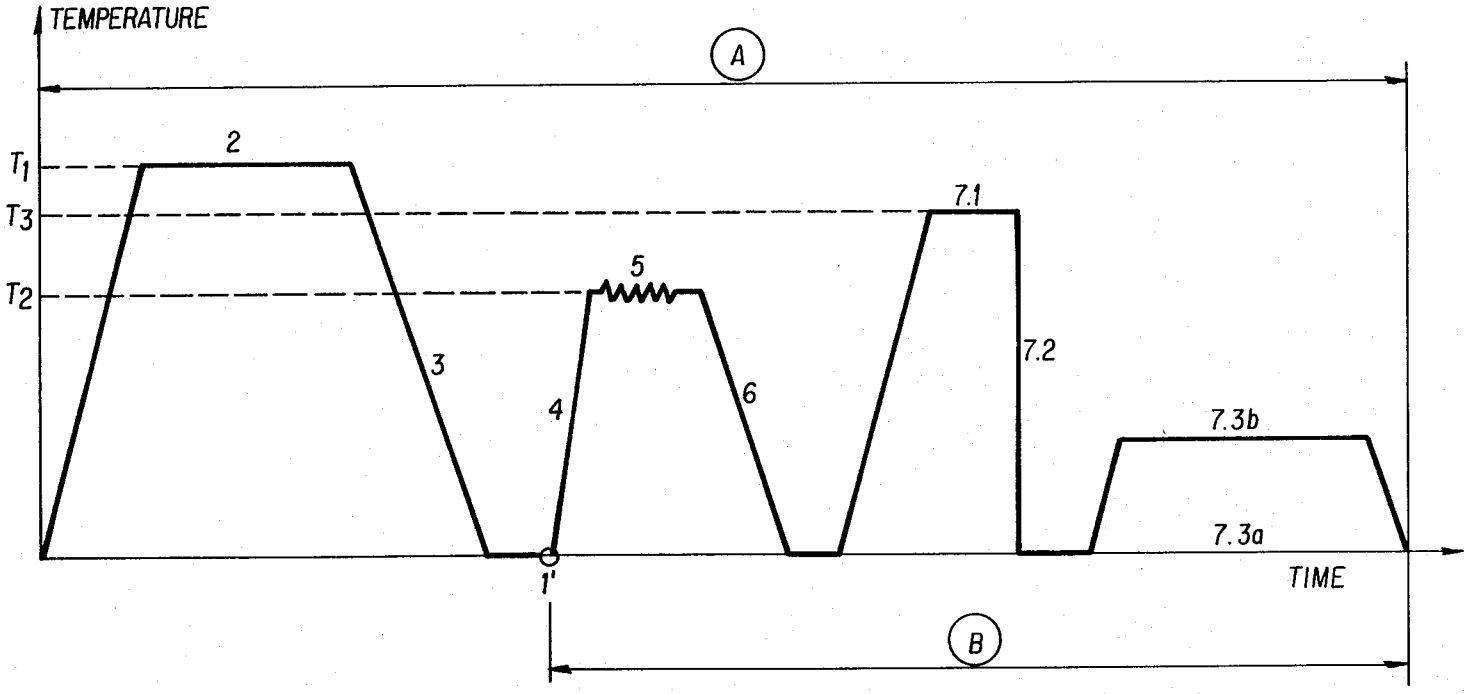

The invention relates to a method of manufacturing stamped-out or forged parts made of structurally hardened, high-resistance aluminum alloys, in particular those corresponding to the 2000,6000 and 7000 series of the Aluminium Association, the ultimate tensile strength of which ($R_m$) in the treated state is greater than or equal to 280 MPa.

The current technique for manufacturing forged or stamped-out parts made of high-resistance Al alloys comprises the following stages:

1. Initial product formation: Metal cast by the classic method of semi-continuous casting.

2. Homogenization: This treatment consists in keeping the alloys at a high temperature (490° C. to 620° C., depending on the alloys) for rather long periods of time (4 to 48 h). This treatment is generally necessary, on the one hand, to impart sufficient plasticity to the metal for its subsequent hot transformation and, on the other hand, to obtain the correct characteristics of use in the finished products.

3. Cooling to the ambient temperature.

4. Heating to the die-stamping temperature. This heating consists of bringing the metal to the temperature at which it can be deformed plastically.

5. The actual operation of hot deformation. This operation is currently performed by forging and die stamping.

6. Cooling of the part to ambient temperature.

7. Thermal treatment. In the case of the high-resistance aluminium alloys forming the object of the present application, a thermal treatment is necessary in order to obtain a structural hardening. This treatment comprises the following phases:

7.1. Placing the alloy in solid solution (the temperature and the duration of which are a function of the nature of the alloy).

7.2. Quenching, that is, the passage of the temperature when placed in solution to ambient temperature at a speed sufficient (greater than the so called critical speed) to obtain the solid solution in the metastable state at the ambient temperature.

7.3. Precipitation of the hardening phase or phases (a) either by natural aging at the ambient temperature, (b) or by a tempering treatment.

This range is not adapted to the mass-production of parts on account of the many stages and the incompatability existing between some of them, in particular as concerns the relative duration of the different operations.

However, the existence of rapid die-stamping or forging presses at one or several work stations and, in this latter instance, automatic transfer of the part being deformed from one station to another, allows the following method, the object of the invention, to be applied for mass production on continuous automated lines.

If one begins with cast blooms, they are cooled after homogenization at temperature $T_1$ to deformation temperature $T_2$ (if $T_1 \neq T_2$) at an accelerated cooling speed, then immediately deformed under heat and quenched right at the end of this operation.

If one begins with blooms of homogenized and prewrought alloys or of alloys which do not require preliminary homogenization, the method is basically identical, except that the heating before deformation is performed at temperature $T_3$ and during the times customarily used for the classic solution heat treatment before quenching (instead of temperature $T_1$).

Temperature $T_1$ is the usual homogenization temperature of the alloys under consideration. There is a list of them, for example in "ALUMINIUM" by VAN HORN, ASM, 1967, vol. III, p. 325 for different alloys. This temperature must be maintained long enough to allow the main alloy elements to be put in solid solution.

Temperature $T_2$ is the temperature at which the start of the forming occurs. This temperature is chosen so that the alloy considered presents a plasticity or aptitude to forming which is sufficient to obtain the part to be made. During the deformation, this temperature can change as a function of the magnitude of this deformation, of the deformation speed of the temperature of the tools and of the nature of the alloy and can reach the value of $T'_2$.

Temperature $T_3$ is the temperature of the solution heat treatment of the alloy. A list thereof is given, for example, in the work by VAN HORN cited above, p. 332 and ff.

The cooling between homogenization temperature $T_1$ (or the temperature $T_3$ of the solution heat treatment) and temperature $T_2$ of the start of deformation should be performed as rapidly as possible.

The accelerated cooling between $T_1$ (or $T_3$) and $T_2$ is preferably obtained by cooling the bloom by air blasts or by a mist.

Generally speaking, the average cooling speed between homogenization temperature $T_1$ or of temperature $T_3$ of the solution heat treatment and the ambient temperature should be sufficient (greater than the critical quenching speed) to assure good characteristics in the final part. It is customary for structurally hardened aluminum alloys of the 2000,6000 and 7000 series to use this notion of critical quenching speed which depends essentially on the composition of the alloy and on its microstructure, in particular in the critical quenching interval, which also varies according to the nature of the alloy. This critical interval generally occurs between the temperature of the solution heat treatment and a temperature in the vicinity of 200°-250° C. and is located in particular between 400° and 290° C. The critical quenching speed can be defined as the average cooling speed which must be exceeded in the critical interval to avoid a coarse precipitation, which would comprise the final characteristics.

The average cooling speed of the part between the end of the hot deformation ($T'_2$) and the ambient (200° C. in practice) should be greater than the critical quenching speed of the alloy, in particular in the critical quenching interval. This condition of cooling allows the decomposition of the solid solution to be avoided and as a consequence the precipitation of the hardening compounds, whose precipitation could compromise the characteristics of the product, in particular, the mechanical resistance and corrosion resistance.

In fact, the cooling cycle can be defined by using TTP (time, temperature, properties) curves. These curves, characteristic of a given alloy, are shaped in the form of the letter C with the time on the abscissa, and the temperature on the ordinate axis of the curve graph. It is necessary that the curve showing the cooling cycle of the product always be located to the left of the tip or tips of the TTP curve or curves relative to the property or properties considered.

The critical quenching speed of the aluminum alloys depends on the nature of the alloy, on its microstructure but likewise on the final property considered. For example, for alloys of the 2000 and 7000 series with copper, the critical quenching speed is between 20° C. and 100° C./sec. if only the mechanical characteristics of traction are considered, but it can exceed 100° C./sec. if the resistance to intergranular corrosion is considered (e.g. 150° C./sec. for alloy 7075T6 and 500° C./sec. for alloy 2024 T4). For the 7000 alloys without copper the critical quenching speed is much lower (0.5° to 1° C./sec. for alloy 7020 for example). For the 6000 alloys the critical quenching speed varies between 1° and 10° C./sec. (e.g. 1° C./sec. for alloy 6063 and 10° C./sec. for alloy 6061).

The invention will be better understood from the figures and the following examples:

FIG. 1 schematically shows the classic transformation range according to the prior art of cast blooms starting from point 1 (cycle A) or of homogenized and pre-wrought blooms from point 1' (cycle B). The stages are indicated in the first part of the specification (cf. p. 1).

Figure 2A:
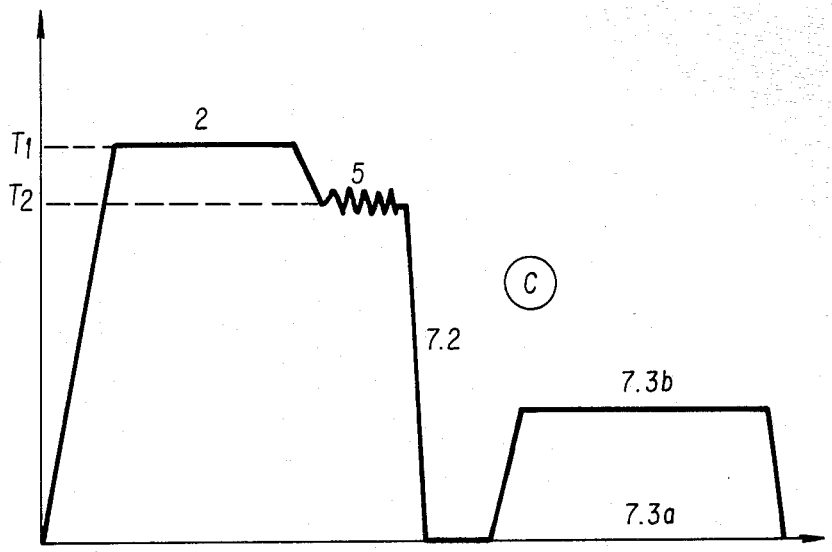
Figure 2B:
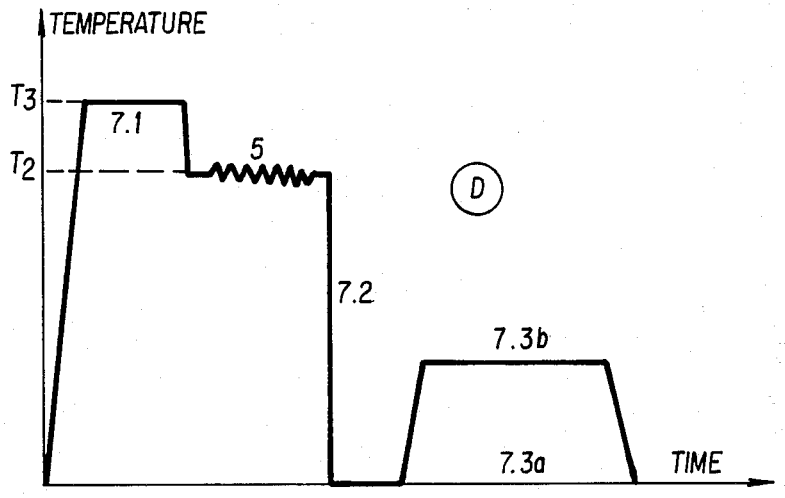

FIG. 2*a* schematically shows the manufacturing range of the invention starting with cast blooms (cycle C), and FIG. 2*b* starting with homogenized and pre-wrought blooms (cycle D).

Figure 3:
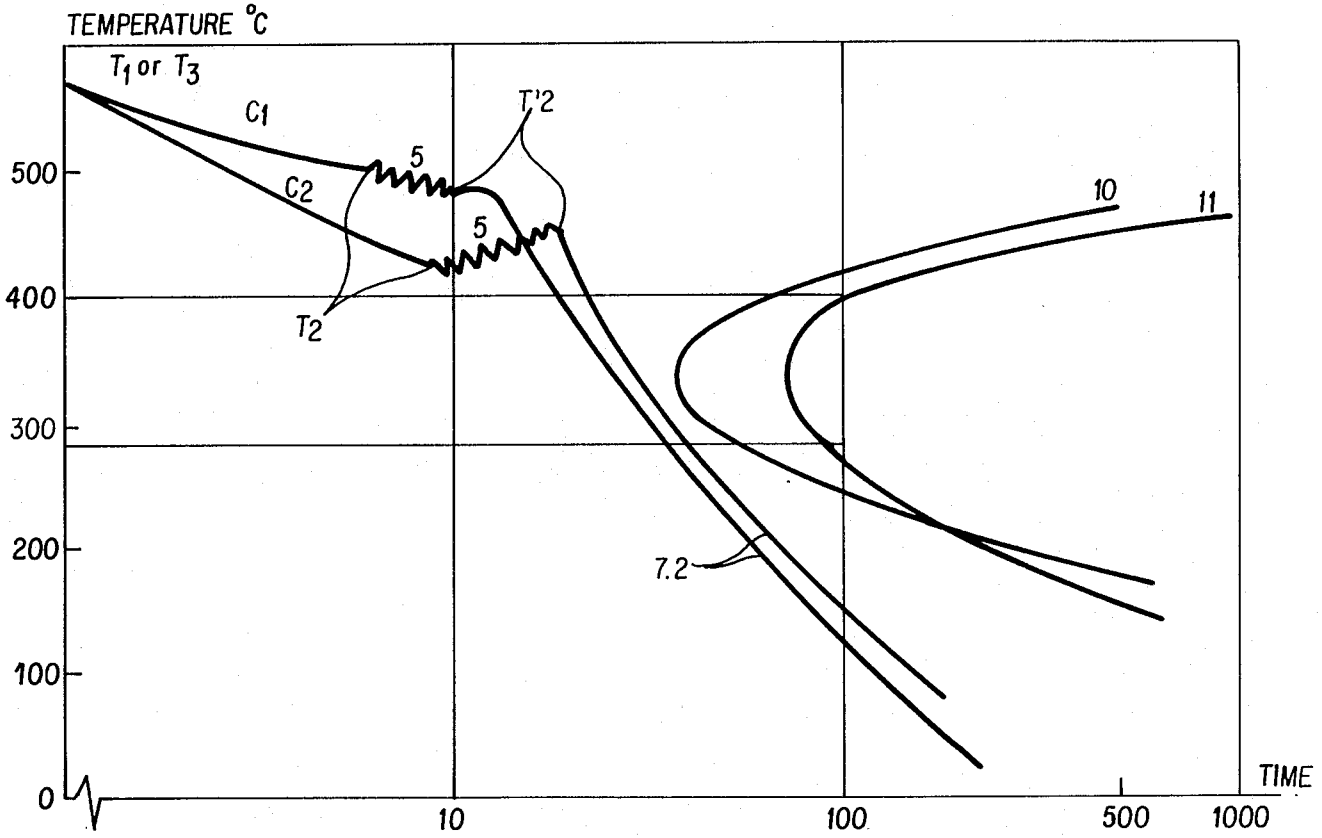

FIG. 3 shows the position of two manufacturing cycles ($C_1$ and $C_2$) opposite TTP curves (10 or 11).

The following examples illustrate the results obtained:

EXAMPLE 1

6061 alloys

| Composition (% by weight) |
|---|
| Si: 0.60 |
| Mg: 1.05 |
| Cu: 0.25 |
| Cr: 0.20 |
| Fe: 0.19 |
| Mn ≦ 0.01 |
| Ti: 0.02 |

Cast billets with a diameter of 60 mm of the same composition underwent each of the following cycles:

| | |
|---|---|
| Cycle A (classic) | |
| homogenization | 6 h at 590° C. |
| cooling to ambient temperature in still air | |
| reheating | to 500° C. |
| die stamping | |
| cooling by air | |
| solution heat treatment | 1 h at 540° C. |
| quenching in water | |
| tempering 24 h after quenching | 8 h at 175° C. |
| Cycle C (according to the invention) | |
| homogenization | 6 h at 580° C. |
| cooling in blast | from 580° C. to 500° C. |
| die stamping | (tool temperature 450° C.) |
| quenching in water | |
| tempering 24 h after quenching | 8 h at 175° C. |

During this cycle the average quenching speed was greater than the critical quenching speed of the alloy, which is on the order of 10° C./second.

The characteristics obtained in the die-stamped parts are:

| CYCLE | RO.2 MPa | Rm MPa | A % |
|---|---|---|---|
| A | 277 | 310 | 13.6 |
| C | 282 | 321 | 15.5 |

Thus, the characteristics according to cycle C are superior to those obtained according to cycle A.

EXAMPLE 2

2017 alloy

| Composition (% by weight) |
|---|
| Cu: 2.85 |
| Mg: 0.61 |
| Mn: 0.54 |
| Si: 0.35 |
| Fe: 0.41 |
| Cr < 0.01 |
| Zn: 0.01 |
| Ti: 0.02 |

Cast billets with a diameter of 55 mm of the same composition underwent each of the following cycles:

| | |
|---|---|
| Cycle A (classic) | |
| homogenization | 8 h at 490° C. |
| cooling to ambient temperature in still air | |
| reheating | to 420° C. |
| die stamping in one stamp | |
| cooling to ambient temperature in still air | |
| solution heat treatment | 1 h at 495° C. |
| quenching in water | |
| natural aging at the ambient temperature | |
| Cycle C (according to the invention) | |
| homogenization | 8 h at 490° C. |
| cooling in blown air | from 490° C. to 410° C. |
| die stamping in one stamp | (tool temperature 410° C.) |
| quenching in cold water immediately after die stamping | |
| natural aging at the ambient temperature | |

During this cycle the average cooling speed between 450° C. and 250° C. was greater than 20° C./second.

The characteristics obtained for the die-stamped parts are:

| CYCLE | RO.2 MPa | Rm MPa | A % |
|---|---|---|---|
| A | 317 | 455 | 18.6 |
| C | 322 | 461 | 18.5 |

EXAMPLE 3

Al-Zn-Mg alloys Four alloys were tested. Composition (% by weight)

| Alloy (denomination AA) | A-Z5G1,8 (7003) | A-Z5G (7020) | A-Z4G1,5 (7005) | A-Z3G2 (7051) |
|---|---|---|---|---|
| Zn | 5.06 | 4.71 | 4.1 | 3.59 |
| Mg | 0.76 | 1.20 | 1.35 | 2.10 |
| Mn | 0.15 | 0.08 | 0.22 | 0.12 |
| Cr | 0.18 | 0.25 | 0.18 | 0.22 |
| Zr | 0.12 | 0.12 | — | — |
| Fe | 0.23 | 0.24 | 0.23 | 0.22 |
| Si | 0.07 | 0.07 | 0.07 | 0.07 |
| Ti | 0.04 | 0.04 | 0.04 | 0.04 |

Billets with a diameter of 190 mm were obtained for each alloy by semi-continuous casting.

These billets were homogenized for 6 h at 480° C., air-cooled and heated to 420° C. by forging in two heats:

first heat: drawing of the billets in the form of a 50×50 mm square bar second heat: forming to an octagon of 50 mm.

After cutting off blooms with volumes capable of transformation in the form of rods, cycle D was applied, namely:

| | |
|---|---|
| solution heat treatment | 1 h 15 min. at 450° C. |
| die-stamping in one pass in rod form at 450° C. | (tool temperature 420° C.) |
| cold-water quenching | |
| either natural aging | 125 days at the ambient temperature |
| or tempering | 4 h 100° C. & 24 h 130° C. |

The following mechanical characteristics are obtained:

| | aged state | | | tempered state | | |
|---|---|---|---|---|---|---|
| | RO.2 MPa | Rm MPa | A % | RO.2 MPa | Rm MPa | A % |
| A-Z5G0.8 | 210 | 330 | 19 | 305 | 335 | 19 |
| A-Z5G | 250 | 370 | 20 | 350 | 390 | 19 |
| A-Z4G1.5 | 210 | 335 | 21 | 325 | 370 | 20 |

-continued

| | aged state | | | tempered state | | |
|---|---|---|---|---|---|---|
| | RO.2 MPa | Rm MPa | A % | RO.2 MPa | Rm MPa | A % |
| A-Z3G2 | 240 | 380 | 22 | 340 | 400 | 20 |

These characteristics are in conformity with those currently obtained for like alloys in a traditional fashion-cycle B.

Note that these Al-Zn-Mg alloys are particularly adapted to the method claimed, because they present:

a large temperature interval for the solution heat treatment (360° C.–550° C. at least)

a low critical quenching speed (on the order of 0.5°–2° C./second).

What is claimed as new and desired to be secured by Letters Patent of the United States is:

1. A method of manufacturing stamped-out or forged parts made of structurally hardened, high resistance aluminum alloys of the 2000 and 7000 series comprising reheating cast blooms at a temperature $T_1$ equivalent to that of the homogenization of the alloy considered or heating blooms which are cast or homogenized and pre-wrought at a temperature $T_3$ equivalent to that of the solution heat treatment of the alloy considered, immediately hot deforming at a temperature $T_2$, wherein $T_2$ is lower than or equal to $T_1$ (or $T_3$), and wherein the temperature at the end of hot deformation is $T'_2$, immediately quenching, and natural aging or tempering, or a combination thereof, wherein the cooling between $T_1$ (or $T_3$) and $T_2$ is effected by air blasts or by a mist.

2. The method according to claim 1, wherein the average quenching speed between about 400° and 290° C. is greater than the critical quenching speed of the alloy under consideration.

3. The method according to claim 1, wherein the average quenching speed between the end of the hot deformation ($T'_2$) and about 200° C. is greater than the critical quenching speed of the alloy under consideration.

4. The method according to one of claim 1, wherein the average cooling speed between the end of the reheating period at temperature $T_1$ (or $T_3$) and about 200° C. is greater than the critical quenching speed of the alloy under consideration.

5. The method according to one of claim 1, wherein the manufacturing cycle comprised between the end of heating the blooms at temperatures $T_1$ or $T_3$ and the end of the quenching is described by a temperature-time diagram entirely in the zone before the TTP curve or curves of the alloy under consideration.

* * * * *